US005553841A

United States Patent [19]

Greive

[11] Patent Number: 5,553,841

[45] Date of Patent: Sep. 10, 1996

[54] DEVICE FOR PREVENTING MULTIPLE REMOVAL OF PRINTING MATERIAL FROM A SHEET PILE

[75] Inventor: Martin Greive, Heidelberg, Germany

[73] Assignee: Heidelberger Druckmaschinen AG, Heidelberg, Germany

[21] Appl. No.: 312,320

[22] Filed: Sep. 26, 1994

[30] Foreign Application Priority Data

Sep. 24, 1993 [DE] Germany ..... 43 32 515.7

[51] Int. Cl.[6] ..... B65A 3/34

[52] U.S. Cl. ..... 271/104; 271/137

[58] Field of Search ..... 271/104, 105, 271/121, 124, 137

[56] References Cited

U.S. PATENT DOCUMENTS

| | | | |
|---|---|---|---|
| 3,713,645 | 1/1973 | Ferrari et al. | 271/121 |
| 4,344,613 | 8/1982 | Isikawa | 271/105 X |
| 4,437,657 | 3/1984 | Selak | 271/104 X |
| 4,690,395 | 9/1987 | Nowicki | 271/105 X |

FOREIGN PATENT DOCUMENTS

| | | | |
|---|---|---|---|
| 581333 | 7/1933 | Germany | 271/104 |
| 2643388 | 3/1979 | Germany . | |
| 2265108 | 4/1982 | Germany . | |
| 3008156 | 10/1984 | Germany . | |
| 3535802 | 4/1987 | Germany . | |

*Primary Examiner*—William E. Terrell
*Assistant Examiner*—T. Kelly
*Attorney, Agent, or Firm*—Herbert L. Lerner; Laurence A. Greenberg

[57] ABSTRACT

Device for preventing removal of more sheets than a single sheet from the surface of a sheet pile includes fingers distributed on a front stop in vicinity of the surface of the sheet pile along a front side of the sheet pile for separating the sheets in a separating or singling process, at least one bearing member for carrying the fingers, and resilient supports for supporting the bearing member, the resilient supports being adjustable independently of one another with respect to the sheet pile.

4 Claims, 2 Drawing Sheets

DEVICE FOR PREVENTING MULTIPLE REMOVAL OF PRINTING MATERIAL FROM A SHEET PILE

SPECIFICATION

Figure 1:
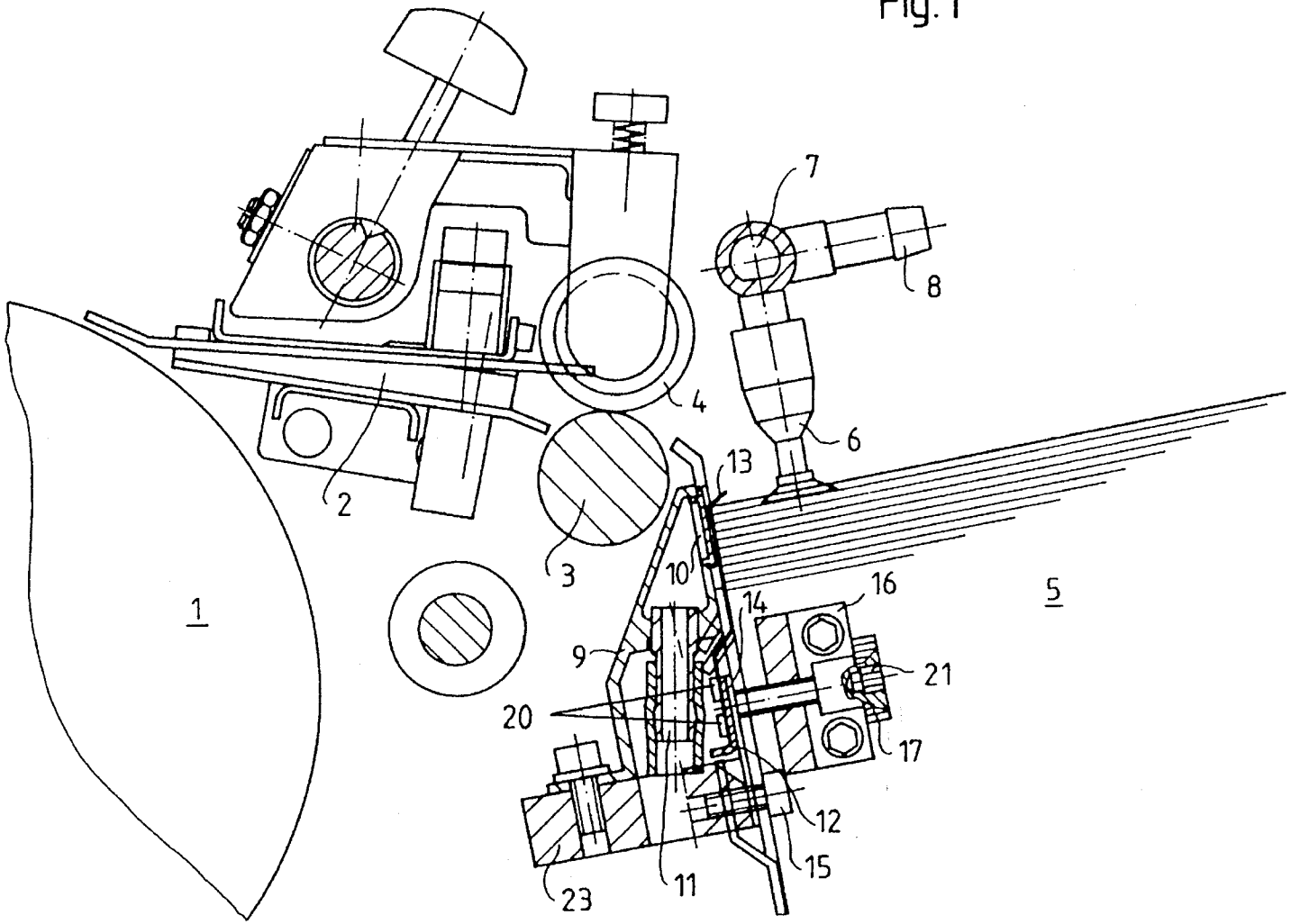

The invention relates to a device for preventing multiple removal of printing material, i.e., more than a single sheet, from the surface of a sheet pile, which includes fingers distributed on a front stop in the vicinity of the surface of the sheet pile along a front side of the sheet pile for separating the sheets in a separating or singling process.

From the state of the art exemplified by the published German Patent Document DE 35 35 802 Al, a device for separating individual sheets of varying stiffness has become known heretofore. With this device, large-sized paper sheets are separated by means of separating corners disposed in the corners of a paper container, whereas small-sized paper sheets are frictionally engaged and separated by means of a spring system acting between mutually engageable friction elements and paper sheets on the bottom of the paper container. The bottom of the sheet pile is pressed against the friction element which, in turn, can be engaged at the surface of the sheet pile in the paper container.

A further prior-art device for separating sheets of a sheet pile has become known heretofore from German Patent 266 43 388 in which sheet-separating means provided at the leading edge of a sheet pile execute a vertically controllable motion by means of a suitably constructed lever system. The lever system is mounted at a lateral boundary of the pile.

The published German Patent Document DE 30 08 156 C2 shows a sheet-retaining system in which hook-shaped sheet-retaining elements driven by means of a four-bar linkage may be pivoted back into the functional position thereof after sheet conveying has begun.

Finally, a separating or singling device provided in a photocopying apparatus has become known heretofore from published German Patent Document DE 22 65 108 C2. Corner-positioned hold-down members or drop guides resiliently mounted on an axis favor an unobstructed removal from a pile surface of sheets having varying stiffness. Sheets seized by advancing rollers are conveyed over a rounded surface area formed by the corner-positioned hold-down members or drop guides. In order to keep the hold-down members or drop guides in an accurate angular position with respect to the surface of the sheet pile, a control device is provided at the sides of the hold-down members or drop guides and serves to compensate for the angular position of the hold-down members or drop guides as the pile height decreases.

A major disadvantage of the aforementioned prior-art solutions is that it is difficult to separate, by means of the aforementioned elements, paper sheets which have become stuck together . Depending upon the paper quality to be processed it is of particular importance to be able to displace the location at which the sheets are mechanically separated from each other to a location at the front stop which is optimally suitable for the respective printing material to be processed. This cannot be achieved by means of the aforementioned prior-art solutions.

Proceeding from the state of the art noted hereinbefore, it is an object of the invention to provide an improved device for preventing multiple removal of printing material, i.e., sheets, from a sheet pile even when the sheets are of varying paper quality and are stuck together.

With the foregoing and other objects in view, there is provided, in accordance with the invention, a device for preventing removal of more sheets than a single sheet from the surface of a sheet pile, comprising fingers distributed on a front stop in vicinity of the surface of the sheet pile along a front side of the sheet pile for separating the sheets in a separating or singling process, bearing means for carrying the fingers, and resilient supports for supporting the bearing means, the resilient supports being adjustable independently of one another with respect to the sheet pile.

In accordance with another feature of the invention, the resilient supports are formed as leaf springs mounted on a traverse.

In accordance with a further feature of the invention, the device includes adjusting screws operatively engageable with the bearing means for deflecting the bearing means in vicinity of respective ends thereof.

In accordance with an added feature of the invention, the fingers are formed as separating springs, and air outlet openings are formed in the front stop and face towards the front side of the sheet pile, the air outlet openings being located between the fingers individually.

In accordance with a concomitant feature of the invention, the bearing means comprise a rail whereon the separating fingers are mounted, the rail being adjustable in a recess formed in the front stop asymmetrically with respect to the sheet pile.

Thus, in accordance with the invention, fingers are mounted on resilient supports which can be individually adjusted with respect to the sheet pile.

Further in accordance with the invention, in addition to a sensitive adjustability of the separating fingers, an asymmetric adjustment thereof with respect to the sheet pile is able to be performed. It is thereby possible to take the different paper qualities better into account. Moreover, it is possible to apply the construction according to the invention without any difficulties in the region of the front stop provided at the sheet pile, because relatively little space is required therefor.

Features of the inventive subject-matter are that the supports are constructed as leaf or plate springs fastened to a traverse; furthermore, the separating fingers are mounted so as to be very favorably deflectable in the end region of the bearing; fanning and blowing underneath the sheets to be separated is effected through outlets provided between the individual separating fingers; and the bearing receiving the fingers is mounted in a recess formed in the front stop, which contributes to a particularly space-saving arrangement of the separating fingers.

Other features which are considered as characteristic for the invention are set forth in the appended claims.

Although the invention is illustrated and described herein as embodied in a device for preventing multiple removal of printing material from a sheet pile, it is nevertheless not intended to be limited to the details shown, since various modifications and structural changes may be made therein without departing from the spirit of the invention and within the scope and range of equivalents of the claims.

Figure 2:
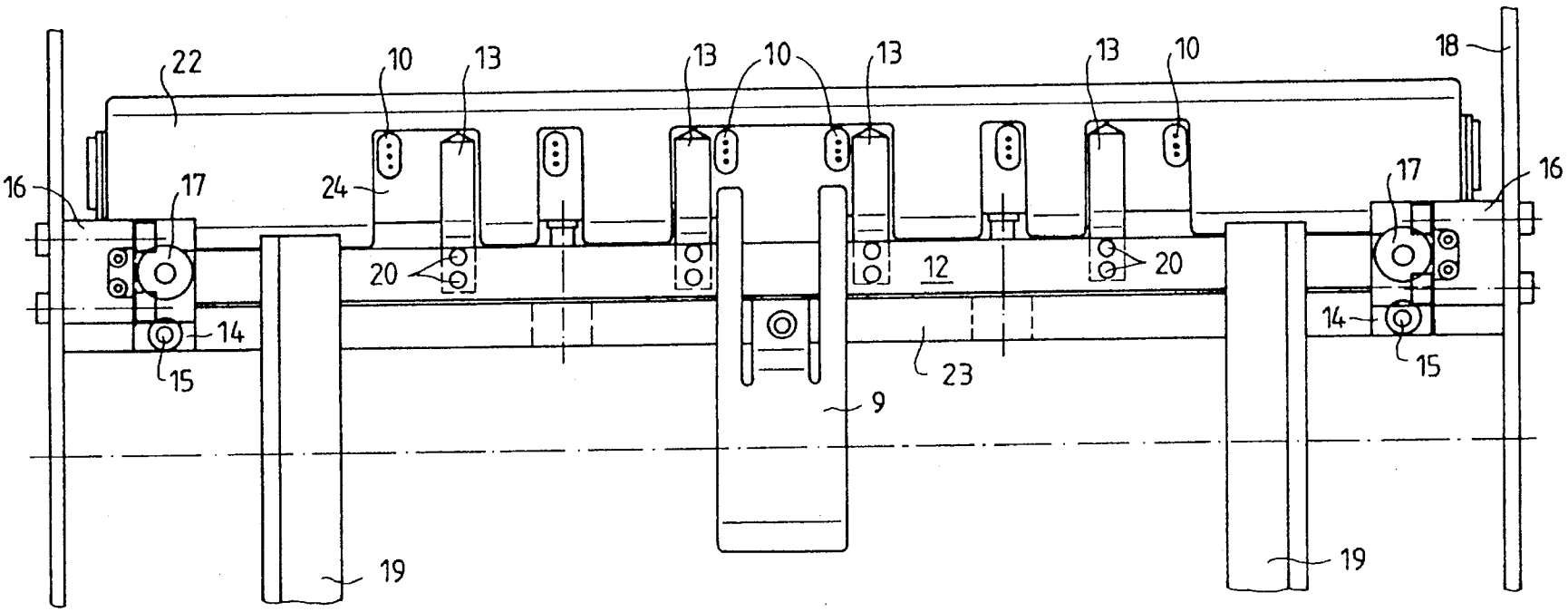

The construction and method of operation of the invention, however, together with additional objects and advantages thereof will be best understood from the following description of specific embodiments when read in connection with the accompanying drawings, in which:

FIG. 1 is a side elevational view, partly in section, of an upper front region of a sheet pile with a front stop; and FIG. 2 is a front elevational view of the front stop showing a bearing support system for separating fingers and pile guides in accordance with the invention.

Referring now to the drawings and, first, particularly to FIG. 1 thereof, there is shown therein a printing-unit cylinder 1 to which separated or singled sheets are fed from a sheet pile 5 in a feeding plane 2. Each of the sheets, respectively, is sequentially gripped at the surface of the sheet pile 5 by means of suckers 6 supported on a pivotal suction bar 7 which is supplied with air by an air connection or union 8. The pivotal or swivelable suckers 6 forward the sheets to transport rollers 3 and 4, the mutual engagement of which can be manually altered or adjusted. The sheets are fed via the feeding plane 2 to the impression cylinder 1 which, however, forms no part of the invention of the instant application.

In the vicinity of the separating fingers 13, the front stop 9 is formed with air outlet openings 10 to which blowing air is supplied via a blowing-air supply system 11 for blowing the air underneath the upper region of the sheet pile 5 and for fanning the individual sheets. In the vicinity of a recess formed in the front stop 9, resilient supports 14 are fastened to a traverse 23 by means of screws 15. The resilient supports 14, preferably realized as leaf or plate springs, carry a bearing rail 12 to which individual separating fingers 13 are fastened, for example, by means of rivets 20. The separating fingers 13 are resilient or springy components having hook-shaped ends bent towards the sheet pile 5.

In the illustrated embodiment according to the invention, for example, the bearing rail 12 has an L-shaped profile and can be deflected by means of an adjusting screw 17. Turning the respective adjusting screw 17 in a holder 16 thereof causes a bending of the leaf-type spring 14 by an amount corresponding to the turn applied to the adjusting screw 17. When the adjusting screw 17 is turned back towards the sheet pile 5, the leaf springs 14 return to the initial positions thereof and cause the separating fingers 13 attached to the bearing rail 12 to move into the pile region. If the leaf or plate springs 14, however, are deflected towards the printing-unit cylinder 1, the bearing rail 12 together with the separating fingers 13 moves out of the pile region.

Because each of the end regions of the bearing rail 12 can be deflected independently of one another, a possibility is provided of asymmetrically adjusting the bearing rail 12 and thus the separating fingers 13 with respect to the leading edge of the sheet pile. Thus, the location at which the hook-shaped ends of the separating fingers 13 touch leading edges of sheets which are stuck together may be varied over the entire width of the sheet pile 5, thereby ensuring an adjustment of the optimum position of a respective separating finger 13 for every sheet quality.

The ends of the bearing rail 12 are deflected by turning a respective adjusting screw 17 the threaded pin of which presses on a respective end of the rail 12. The adjusting screws 17 may be provided with hexagon heads and may be formed as knurled screws so as to be turnable without having to use tools, or they may be formed as hexagonally recessed knurled-head screws 21, as shown in FIG. 1.

FIG. 2 is a front elevational view of the construction according to the invention, wherein the sheets to be processed between the pile guides 19 are not shown. The bearing rail 12 is provided with a plurality of separating fingers 13 fixed, for example, by means of rivets 20 thereto. The hook-shaped ends of the separating fingers 13 have an approximately triangular construction. The two holders 16, respectively, fixed on side walls 18 have an adjusting screw 17. The leaf or plate springs 14 are held on the traverse 23 by means of screws 15. A cover 22 on the front stop 9 leaves recesses 24 uncovered in the vicinity of the blowing-air outlets 10 and the separating fingers 13 so that, on one hand, the blowing air may fan the surface of the sheet pile 5 without being obstructed, and so that, on the other hand, the resiliently constructed separating fingers 13 may be swung or deflected outwardly.

The foregoing is a description corresponding in substance to German Application P 43 32 515.7, dated Sep. 24, 1993, the International priority of which is being claimed for the instant application, and which is hereby made part of this application. Any material discrepancies between the foregoing specification and the aforementioned corresponding German application are to be resolved in favor of the latter.

I claim:

1. Device for preventing removal of more sheets than a single sheet from a sheet pile, comprising fingers distributed on a front stop in the vicinity of the surface of the sheet pile along a front side of the sheet pile for separating the sheets in a separating process, bearing means carrying said fingers, and resilient supports for supporting said bearing means, said bearing means having first and second ends, said resilient supports being adjustable independently of one another with respect to the sheet pile, and including adjusting screws operatively engageable with said bearing means in the vicinity of said first and second ends for deflecting said bearing means.

2. Device according to claim 1, wherein said resilient supports are leaf springs mounted on a traverse.

3. Device for preventing removal of more sheets than a single sheet from a sheet pile, comprising fingers distributed on a front stop in vicinity of the surface of the sheet pile along a front side of the sheet pile for separating the sheets in a separating process, deflectably mounted bearing means commonly carrying said fingers, and resilient supports for supporting said bearing means, said resilient supports being adjustable independently of one another with respect to the sheet pile, wherein said fingers are separating springs, and including air outlet openings formed in the front stop and facing towards the front side of the sheet pile, said air outlet openings being located between said fingers individually.

4. Device for preventing removal of more sheets than a single sheet from a sheet pile, comprising fingers distributed on a front stop in vicinity of the surface of the sheet pile along a front side of the sheet pile for separating the sheets in a separating process, deflectably mounted bearing means commonly carrying said fingers, and resilient supports for supporting said bearing means, said resilient supports being adjustable independently of one another with respect to the sheet pile, wherein said bearing means comprise a rail whereon said separating fingers are mounted, said rail being adjustable in a recess formed in the front stop asymmetrically with respect to the sheet pile.

* * * * *